US007578727B2

(12) United States Patent
Moon et al.

(10) Patent No.: US 7,578,727 B2
(45) Date of Patent: Aug. 25, 2009

(54) CONDITIONER DEVICE FOR CONDITIONING POLISHING PAD AND CHEMICAL MECHANICAL POLISHING APPARATUS INCLUDING THE SAME

(75) Inventors: Sung-Tae Moon, Gyeonggi-do (KR); Dong-Jun Lee, Seoul (KR); Kyoung-Moon Kang, Gyeonggi-do (KR); Nam-Soo Kim, Gyeonggi-do (KR); Bong-Su Ahn, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 46 days.

(21) Appl. No.: 11/466,425

(22) Filed: Aug. 22, 2006

(65) Prior Publication Data

US 2007/0167117 A1 Jul. 19, 2007

(30) Foreign Application Priority Data

Dec. 29, 2005 (KR) ..... 10-2005-0133590

(51) Int. Cl.
*B24B 53/00* (2006.01)

(52) U.S. Cl. ..... 451/72; 451/443; 451/56

(58) Field of Classification Search ..... 451/443, 451/444, 56, 72, 288, 287
See application file for complete search history.

(56) References Cited

U.S. PATENT DOCUMENTS 6,213,856 B1 * 4/2001 Cho et al. ..... 451/443
6,884,155 B2 * 4/2005 Sung et al. ..... 451/443
6,949,012 B2 * 9/2005 Barnett, III ..... 451/56
7,066,795 B2 * 6/2006 Balagani et al. ..... 451/285
2004/0072510 A1 4/2004 Kinoshita et al.
2004/0110453 A1 6/2004 Barnett et al.

FOREIGN PATENT DOCUMENTS

JP 2001-121418 5/2002
JP 2003-071718 3/2003
KR 2003/0063408 7/2003
KR 2004-0070492 8/2004

OTHER PUBLICATIONS

English language abstract for Korean Publication No. 2003-0063408.
English language abstract for Japanese Publication No. 2001-121418.
English language abstract for Japanese Publication No. 2003-071718.

* cited by examiner

*Primary Examiner*—Robert A. Rose
(74) *Attorney, Agent, or Firm*—Marger Johnson & McCollom, P.C.

(57) ABSTRACT

The present invention relates to a conditioner device for polishing pad and a chemical mechanical polishing (CMP) apparatus having the same. The conditioner device of the present invention comprises a rotable support plate including a support plate surface comprising a center area located about the rotational axis of the support plate, a mid area surrounding the center area, and a peripheral area surrounding the mid area, a plurality of conditioning zones located within a portion of the mid area of the support plate surface. A plurality of hard particles which are densely arranged within the conditioning zones and are attached to the support plate surface. A plurality of passages defined by the conditioning zones within which a slurry flows, the passages occupying a portion of the mid area which is not occupied by the conditioning zones, the center area and the peripheral area.

24 Claims, 11 Drawing Sheets

CONDITIONER DEVICE FOR CONDITIONING POLISHING PAD AND CHEMICAL MECHANICAL POLISHING APPARATUS INCLUDING THE SAME

CROSS-REFERENCE TO RELATED APPLICATIONS

This U.S. non-provisional patent application claims priority under 35 U.S.C. § 119 from Korean Patent Application No. 2005-133590 filed on Dec. 29, 2005, the entire contents of which are hereby incorporated by reference.

BACKGROUND

1. Field of the Invention

The present invention relates to an apparatus for manufacturing semiconductor devices. More particularly, the present invention relates to a conditioner device that can maintain a polishing rate of a polishing pad at a sufficient level, and also to a chemical mechanical polishing (CMP) apparatus having the same.

2. Discussion of the Related Art

With the integration density of a semiconductor device increasing, a tiny scratch or defect imposed on a wafer during a CMP process is considered as one of the major factors that deteriorate the productivity and yield in manufacturing the semiconductor device. Especially in the recent semiconductor manufacturing processes which uses large diameter wafers, for example, wafers of about 300 mm in diameter, the size of a polishing pad becomes larger with the increased size of the wafer. Accordingly, the stress and impact imparted on the surface of the wafer and the polishing pad during the CMP process are increasing, and in turn scratches or defects on the wafers are occurring more frequently.

The CMP process, as is well known in the field of this art, is for polishing the wafer with a polishing pad while simultaneously supplying a slurry to the wafer which is to be planarized. The slurry, byproducts of the polishing process, and various kinds of contaminants are deposited on the polishing pad during the CMP process, lowering the conditioning efficiency. To prevent this problem, a conditioner device is typically used. The conditioner device carries out a conditioning process for the polishing pad, it maintains the surface condition of the polishing pad at a constant level.

FIG. 1 illustrates the surface of the polishing pad of the conventional CMP apparatus. Referring to FIG. 1, the conventional conditioner device 10 includes (artificial) diamond particles distributed on a plurality of conditioning zones 12. The support plate 11 is partitioned into many conditioning zones 12. For example, about 50,000 to 60,000 artificial diamonds having diameters of about 110 μm are distributed at a separation distance of about 300 μm on the conditioner device 10. The gaps between the conditioning zones 12 are about 1.5 mm, and the diameter of the center area is about 10 mm, and the width of the peripheral area where no diamonds is about 6 mm.

Various kinds of slurries are used for the CMP process. The slurry can be strong acid or a strong alkali, containing different amounts of polishing particles. The lifetime of the conditioner device tends to be determined by the types of the slurries.

For instance, referring to Table 1 below, the lifetime of the conditioner device is different, depending on the type of the polished material layer and the slurry, even though the polishing pad and the conditioner device are the same.

TABLE 1

| CMP process | Slurry | Life Time of Conditioner Device (hours) |
|---|---|---|
| Oxide CMP | Silica | 25~35 |
| Oxide CMP | Ceria | 25~50 |
| Tungsten CMP | Tungsten | Below 20 |

Referring to FIG. 2, after 20 hours of usage, the conditioning capability or conditioning efficiency of the polishing pad has decreased by about 30% from the initial value for the ceria slurry (B) and the silica slurry (C), whereas the decrease is more than 70% for the tungsten slurry (A).

Referring to FIG. 3, as described above, about sixty thousands diamond particles 13, having diameters of about 100 μm, are attached to the circular support plate 13 by the layer of an adhesive 11*a*, the diamond particles being separated by a distance of about 300 μm from one another. The mobility of the slurry 14 is very low between the closely spaced diamond particles 13. Since the area between the plate 11 and the pad 15 not containing the diamond particles 13 is narrow, it is difficult for the slurry 14 to flow into and away from the conditioner device 10. When the number of the diamond particles 13 distributed on the conditioner device 10 is increased, the conditioning efficiency of the polishing pad 15 is better for the initial period of the usage. However, when the separation distances between the diamond particles 13 are closer, the mobility of the slurry 14 is reduced, and the diamond particles 13 erode more quickly.

As explained above, the slurry remaining in the conditioner device abrades the diamond particles. Especially, the abrasion of the diamond particles becomes a much more serious problem for the tungsten slurry that carries the chemicals of a strong acid and the polishing particles of which hardness being no less than that of the diamond particles. It is considered that this explains why the conditioning efficiency to the polishing pad in the CMP process decreases much more quickly for the tungsten than for the silica or ceria slurry. The decrease of the conditioning efficiency to the polishing pad causes many problems such as shortening the lifetime of the conditioner device, deteriorating the reliability of the polishing process, and increasing the process time.

SUMMARY OF THE INVENTION

The present invention provides a new conditioner device for the polishing pad of a CMP apparatus, the conditioner device that allows the mobility of a slurry significantly enhanced.

According to an exemplary embodiment of the present invention, a conditioner device comprises a rotable support plate including a support plate surface comprising a center area located about the rotational axis of the support plate, a mid area surrounding the center area, and a peripheral area surrounding the mid area. A plurality of conditioning zones are located within a portion of the mid area of the support plate surface. A plurality of hard particles, which are densely arranged within the conditioning zones, are attached to the support plate surface. A plurality of passages are defined by the conditioning zones within which a slurry flows. The passages occupy a portion of the mid area which is not occupied by the conditioning zones, the center area and the peripheral area.

The plurality of conditioning zones preferably occupy from about 60% to 70% of the total area of the support plate surface. The plurality of passages preferably occupy about 30% to 40% of the total area of the support plate surface, and partitions the plurality of conditioning zones. The average distance between the plurality of the hard particles is preferably about 5 to 7 times the average size of the hard particles. The plurality of hard particles can be arranged such that each hard particle is located at each corner of a square grid. The plurality of hard particles can also have extruding heights which are different from each other, the extruding heights being measured from the support plate surface. The difference of these extruding heights of the plurality of hard particles are preferably from about 10% to 20% of the average size of the plurality of the hard particles. Preferably, the plurality of the hard particles comprise diamond particles.

In another embodiment, a conditioner device is provided which comprises a rotatable circular support plate including a support plate surface comprising a circular-shaped center area located about the rotational axis of the support plate surface, a ring-shaped mid area surrounding the center area, and a ring-shaped peripheral area surrounding the mid area. A plurality of radially-extending conditioning zones can be located within the mid area of the support plate surface. A plurality of hard particles can be densely arranged within the conditioning zones and are attached to the support place surface. A plurality of slurry passages can be provided comprising a first slurry passage that is circular and is defined by the center area, a second slurry passage that is a ring shape and is defined by the peripheral area, and a third slurry passage that is defined by the regions between the plurality of the conditioning zones and connects the respective first slurry passage and the second slurry passage.

In one embodiment, the plurality of the conditioning zones are shaped as follows: the conditioning zone of which boundaries extend along straight lines from the rotation axis of the support plate to the peripheral edge of the support plate, with the azimuthal dimension of the conditioning zone gradually increasing with the radial distances from the rotation axis of the support plate. In another embodiment, the plurality of the conditioning zones are shaped as follows: the conditioning zone of which boundaries extend along curved lines from the rotation axis of the support plate to the peripheral edge of the support plate, with the azimuthal dimension of the conditioning zone gradually increasing with the radial distances from the rotation axis of the support plate. In a further embodiment, the plurality of the conditioning zones are shaped as follows: the conditioning zone of which boundaries extend along curved lines from the rotation axis of the support plate to the peripheral edge of the support plate, with the azimuthal dimension of the conditioning zone being substantially constant at any radial distance from the rotation axis of the support plate. In still a further embodiment, the plurality of the conditioning zones are shaped as follows: the conditioning zone which extends in the azimuthal direction of the support plate, with the radial dimension of the conditioning zone being substantially constant at any azimuthal location.

A chemical mechanical polishing apparatus can also be provided. This apparatus can comprise a rotatable platen, a polishing pad positioned on the platen, and a rotatable wafer carrier for mounting and polishing a wafer. The wafer carrier faces the polishing pad. It also includes a slurry supply nozzle for supplying a slurry to the polishing pad. A rotatable conditioner device can be supplied comprising a support plate surface. The support plate surface can comprise a plurality of conditioning zones having a plurality of hard particles which are densely arranged within the conditioning zones and attached to the support plate surface. The hard particles are for maintaining the surface roughness of the polishing pad. Slurry passages can provide spaces for slurry flows between the plurality of the conditioning zones. A rotational axis comprises an arm to which the conditioner device is installed.

The apparatus preferably includes a plurality of conditioning zones arranged in a radial direction which occupy a portion of a mid area of the support plate, the mid area being located between a center area and a peripheral area of the support plate. The slurry passage can comprise a first slurry passage that is a circular shape and is located in the center area, a second slurry passage that is a ring shape and is located in the peripheral area, and a third slurry passage that is located in the regions between the plurality of the conditioning zones and connects the first slurry passage and the second slurry passage.

According to the present invention, the changes in the arrangement configurations of the diamond particles enhance the mobility of the slurry, lowering the abrasion of the diamond particles. Thus the conditioning efficiency of the polishing pad is increased and the lifetime of the conditioner device is prolonged. In addition, by adjusting the extrusion heights of the diamond particles, the conditioning efficiency of the polishing pad can be set or maintained as desired.

BRIEF DESCRIPTION OF THE DRAWINGS

The above and other advantages of the present invention will become readily apparent by reference to the following detailed description when considered in conjunction with accompanying drawings wherein.

DESCRIPTION OF THE EMBODIMENTS

Hereinafter, the embodiments of the present invention will be described below in more detail with reference to the accompanying drawings. The present invention may, however, be embodied in different forms and should not be constricted as limited to the embodiments set forth herein. Rather, these embodiments are provided so that this disclosure will be thorough and complete, and will fully convey the scope of the invention to those skilled in the art.

Figure 1:
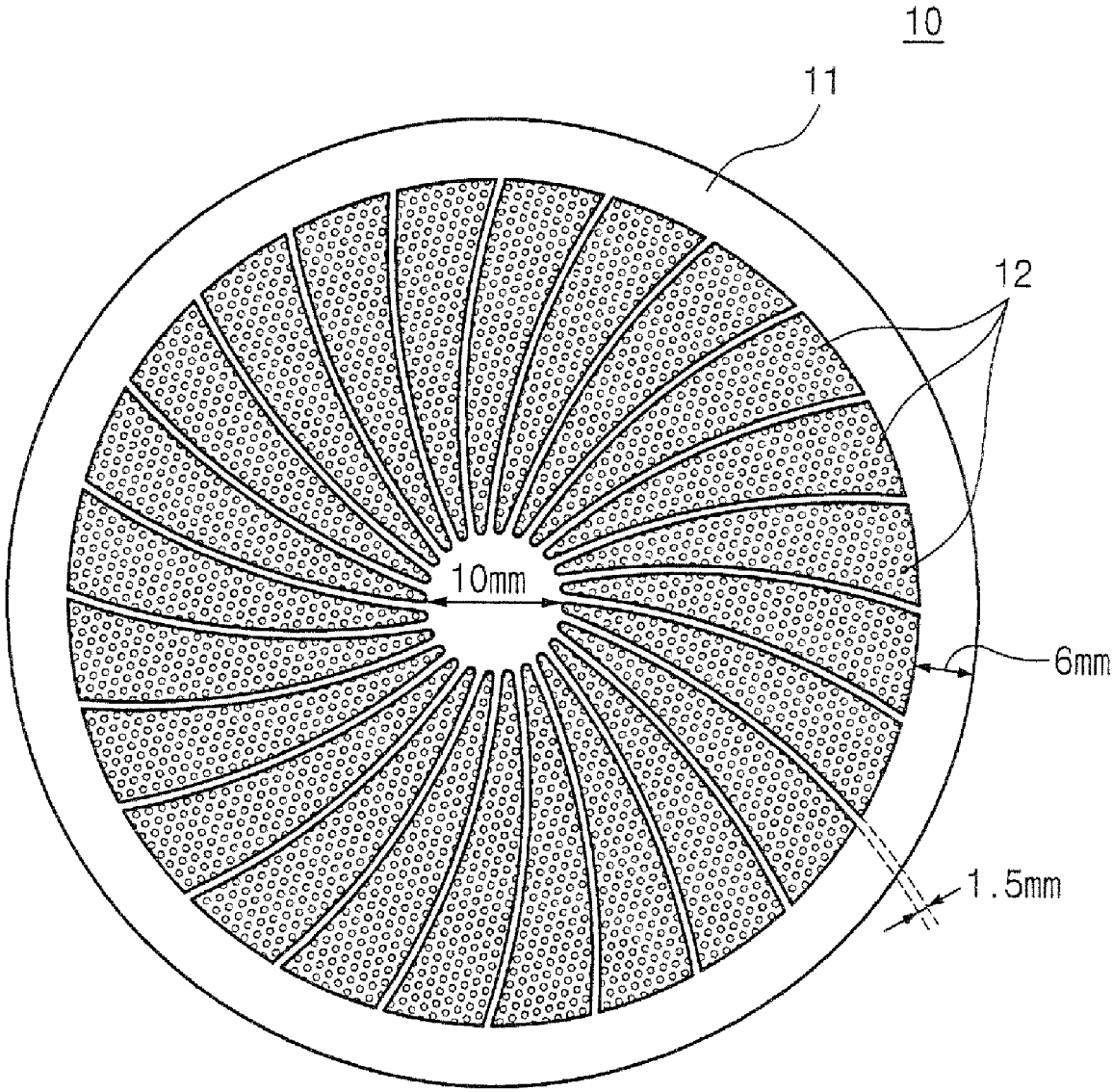
Fig. 1 (CONVENTIONAL ART)
FIG. 1 is a plan view illustrating a conditioner device for the polishing pad of a conventional CMP apparatus.
Figure 2:
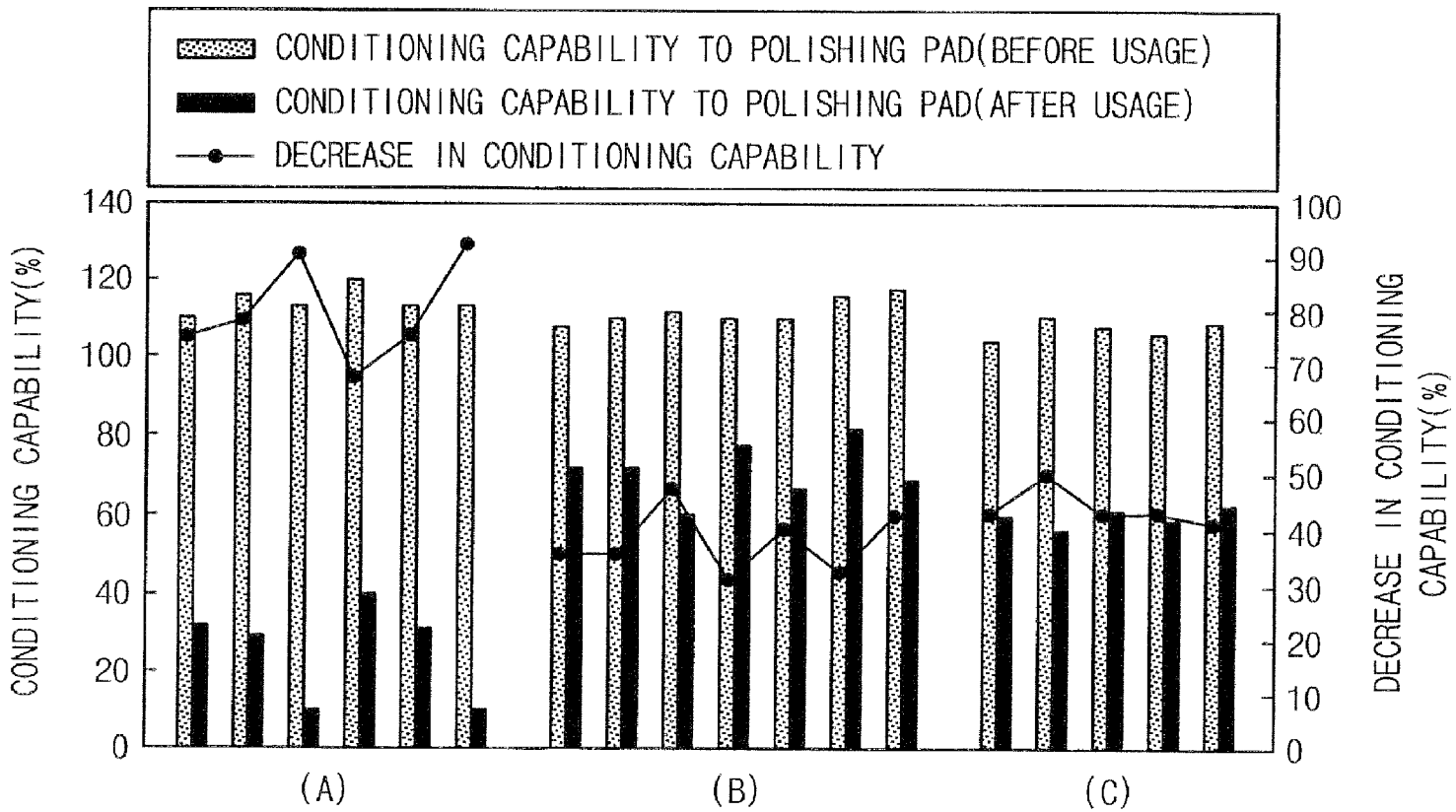
Fig. 2 (CONVENTIONAL ART)
FIG. 2 is a graph illustrating the conditioning efficiency of the polishing pad of a conventional CMP apparatus.
Figure 3:
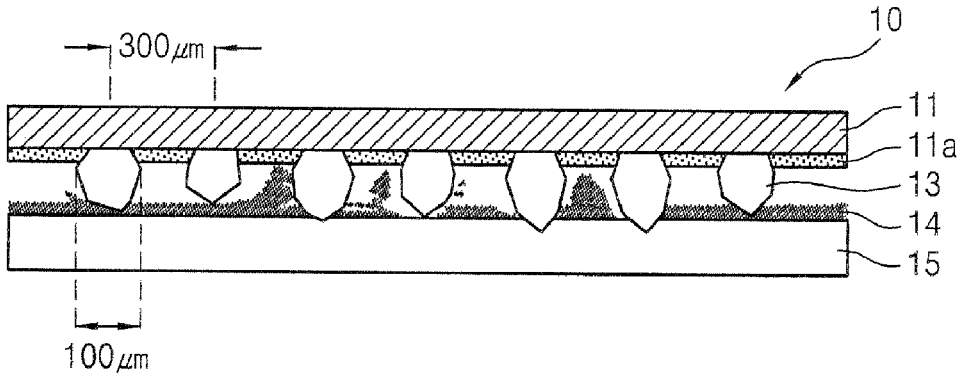
Fig. 3 (CONVENTIONAL ART)
FIG. 3 is a sectional view illustrating a conditioner device for the polishing pad of a conventional CMP apparatus.
Figure 4:
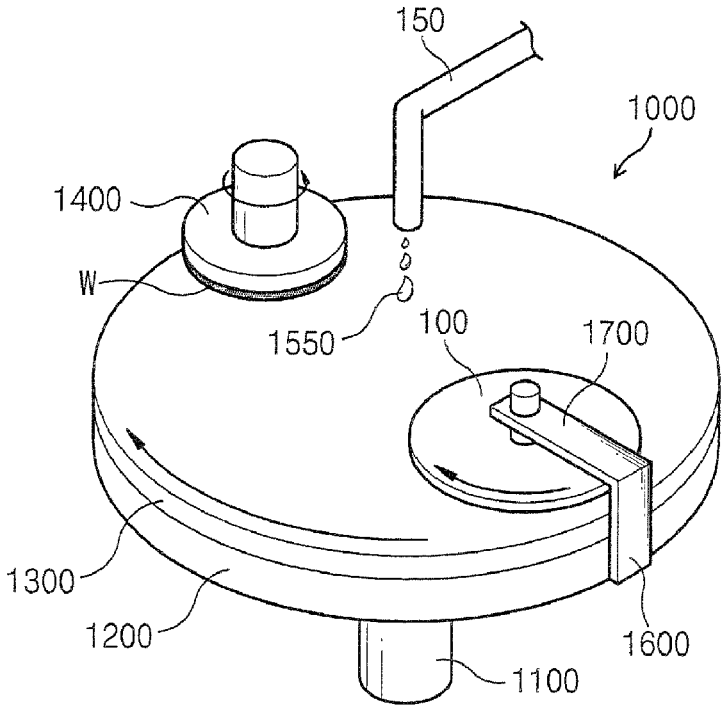
FIG. 4 is a perspective view illustrating a CMP apparatus including the conditioner device for the polishing pad according to an exemplary embodiment of the present invention.

FIG. 4 is a perspective view illustrating a CMP apparatus including the conditioner device for a polishing pad according to an exemplary embodiment of the present invention. Referring to FIG. 4, the CMP apparatus 1000 used for a CMP process includes a platen 1200 that is a circular rotating table, the platen 1200 being installed on a center axis 1100. It also includes a polishing pad 1300 that is, for example, a pad made of a polymeric material such, such as a urethane material, particularly a hard polymeric material, the polishing pad 1300 being installed on the platen 1200. A wafer carrier 1400 that can rotate is also provided, the wafer carrier 1400 being placed at an off-centered location from the center of the polishing pad 1300, the wafer carrier 1400 facing against the polishing pad 1300. The wafer carrier 1400 has a circular shape of a diameter which is less than that of the polishing pad 1300, the wafer carrier 1400 being for mounting a wafer (W). The wafer (W) mounted on the wafer carrier 1400 is in contact with the polishing pad, while the wafer (W) rotating, and a slurry 1550 is supplied from a slurry supply nozzle 1500, whereupon a planarization process taking place.

After repetitions of the CMP polishing, the surface of the polishing pad 1300 becomes smooth, and accordingly the time required for the polishing drastically increases, causing the polishing accuracy of the wafer (W) and the conditioning efficiency to deteriorate. In order to alleviate this problem, the CMP apparatus 1000 includes a conditioner device 100 that repeatedly grinds the surface of the polishing pad 1300 and keeps the surface roughness of the polishing pad 1300 at optimal conditions. The conditioner device 100 is installed on an arm 1700 in a way that the conditioner device 100 can rotate, the arm 1700 extending from a rotational axis arm 1600 which is installed at the outer edge of the platen 1200. The conditioner device 100 grinds the polishing pad 1300 to restore or maintain the surface roughness of the polishing pad 1300, while polishing of the wafer (W) with the wafer carrier 1400 or while having the wafer (W) polishing stopped. The conditioner device 100, as described below, includes a great number of hard particles, such as (artificial) diamond particles, that are distributed densely on a circular metal support plate, the hard particles being attached to the support plate by a nickel adhesive layer.

Figure 5:
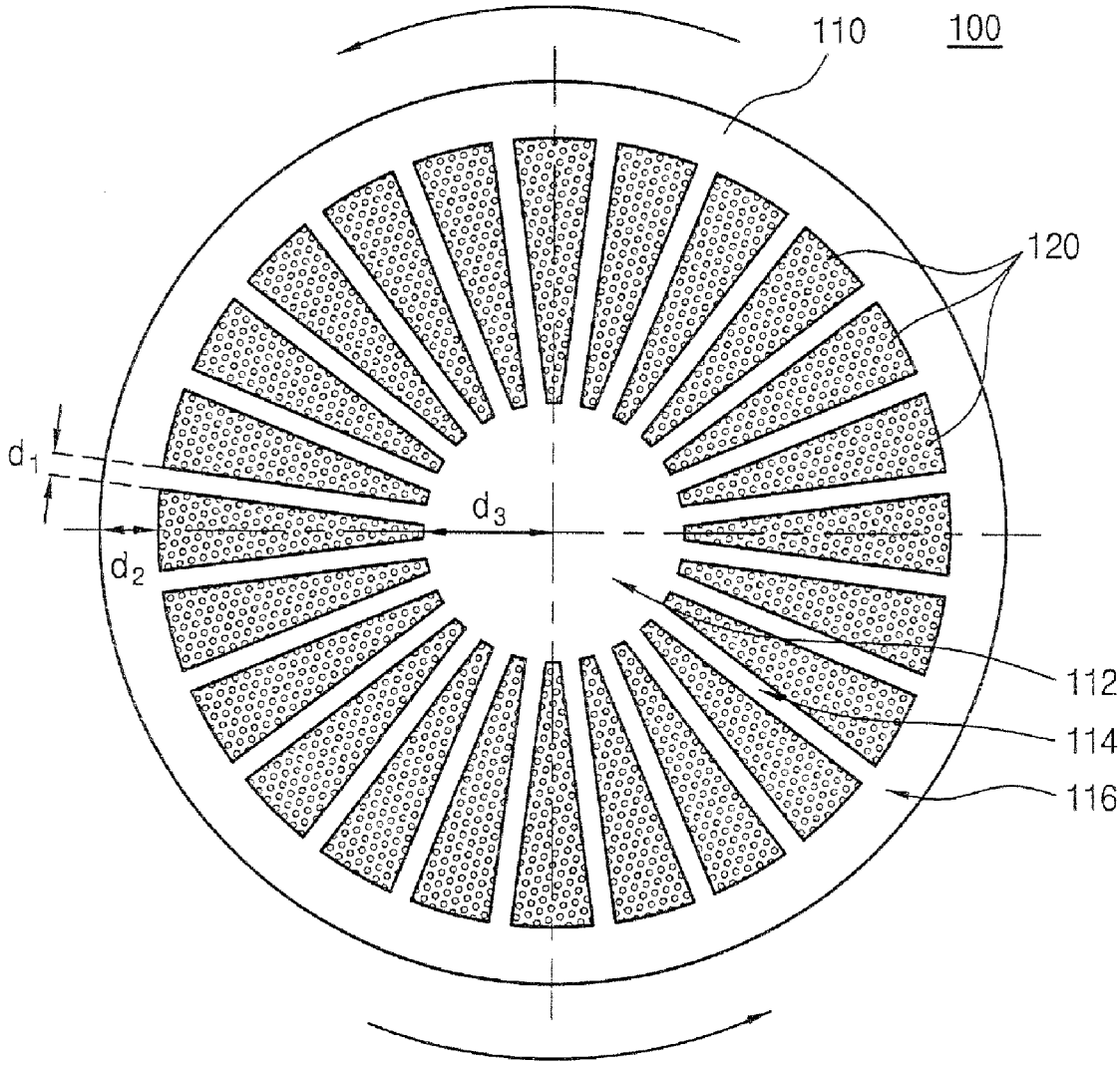
FIG. 5 is a plan view illustrating a CMP apparatus including the conditioner device for the polishing pad according to an exemplary embodiment of the present invention.

Referring to FIG. 5, the conditioner device 100 of this embodiment includes hard particles which are densely distributed over a plurality of conditioning zones 120, the conditioning zones 120 partitioning the circular support plate 110 which is made of metal such as stainless steel. The conditioning zones 120 may have boundaries which extend along straight lines from the rotation axis of the support plate 110 to the peripheral edge of the support plate 110. Accordingly, the azimuthal dimension of the conditioning zones 120 increases gradually with the radial distance from the rotation axis of the support plate 110 to the peripheral edge of the support plate 110.

When the portion of the area occupied by the plurality of conditioning zones 120 is larger in the support plate 110, the mobility of the slurry becomes smaller. Conversely, when the areas of the plurality of conditioning zones 120 are smaller, the conditioning efficiency of the polishing pad is lower. Therefore, it can be optimally designed that the plurality of the conditioning zones 120 occupy from about 60% to 70% of the total area of the support plate 110. In this case, both the conditioning effects of the polishing pad as well as the mobility of slurry are good. The other areas 112, 114, 116, excluding the conditioning zones 120, occupy from about 30% to 40% of the total area of the support plate 110, and serve as passages for the slurry flow.

The plurality of the conditioning zones 120 are arranged regularly in the direction (denoted by solid arrows in FIG. 5) of the rotation of the support plate 110, with the distance between each pair of adjacent conditioning zones 120 kept constant (as $d_1$), thereby providing the flow passages for the slurry. In addition, the plurality of the conditioning zones 120 are separated by a constant distance of $d_2$ from the circumferential edge of the support plate 100 and are separated by a constant distance of $d_3$ from the center of the support plate 100, for enabling the slurry to efficiently flow into or away from the conditioner device 100. Therefore, the plurality of the conditioning zones 120 including the hard particles are arranged in the rotational direction (denoted by solid arrow in FIG. 5) with the constant gap of $d_1$, and the plurality of the conditioning zones 120 occupy the mid area between the center area and the peripheral area of the support plate 100.

Here, the plurality of the parts 114 with the constant width of $d_1$ provide a slurry passage 114 between each conditioning zone 120, the slurry passage 114 through which the slurry can flow efficiently. The plurality of the parts 116, 112 with the constant width of $d_2$ and $d_3$ also provide the slurry passages 116, 112 for efficient slurry flows.

The plurality of the slurry passages 114 are generally straightflow paths connecting the center area and the peripheral area of the support plate 110. If the boundaries of the conditioning zones 120 are curved, the plurality of the slurry passages 114 also include generally curved paths. Therefore, the shapes of the plurality of the slurry passages 114 are determined by the shapes and the arrangement of the conditioning zones 120. This will be explained in detail, referring to FIG. 13 to FIG. 15 below.

The slurry passage 112 is a circular shape, occupying the center area of the support plate 110. The plurality of the slurry passages 114 connect the slurry passage 112 that occupies the center area of the support plate 110 and the slurry passage 116 that occupies the peripheral area of the support plate 110. Along these slurry passages 112, 114, 116, the slurry flows efficiently into and away from the conditioner device 110, the slurry flowing between the conditioning zones 120.

Figure 6:
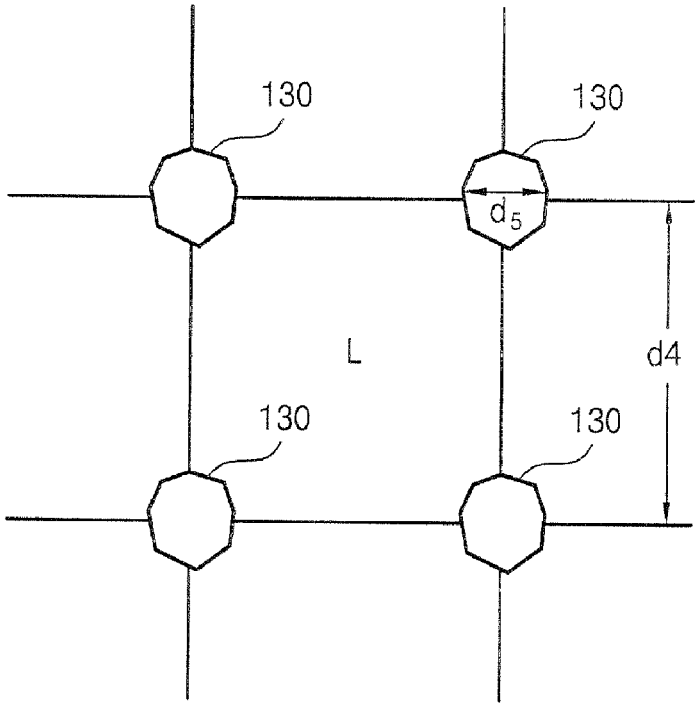
FIG. 6 is a detailed plan view illustrating the arrangement of diamond particles on the conditioner device for the polishing pad of the a CMP apparatus according to an exemplary embodiment of the present invention.

FIG. 6 is a plan view illustrating the arrangement of diamond particles on the conditioner device for the polishing pad of the CMP apparatus according to an exemplary embodiment of the present invention. Referring to FIG. 6, the hard particles are typically the (artificial) diamond particles 130. The diamond particles 130 can be arranged either regularly or irregularly in the conditioner device 100 of the present invention. For example, the diamond particles 130 can be arranged regularly in a square grid (L) configuration, each diamond particle being located at each corner of a square grid. It is recommended in the above example of the regular arrangement that the distance ($d_4$) between the diamond particles 130 be chosen such that the slurry may flow efficiently, conditioning the polishing pad sufficiently.

For example, the average distance ($d_4$) between the diamond particles 130 can be at least about 5 times greater than the average diameter or width ($d_5$) of the diamond particles 130. When the average distance ($d_4$) between the diamond particles 130 is too large, the conditioning effect against the polishing pad can be low. Therefore, it is recommendable that the average distance ($d_4$) between the diamond particles 130 be 5 to 7 times larger than the average diameter or width ($d_5$) of the diamond particles 130. The same is true for the case when the diamond particles are arranged in an irregular way. Even when the diamond particles are arranged irregularly, preferably the average distance ($d_4$) between the diamond particles 130 is 5 to 7 times larger than the average diameter or width ($d_5$) of the diamond particles 130.

In the conditioner device 100 of the present invention, for example, about 30,000 diamond particles can be uniformly distributed over each conditioning zone 120 on the support plate 110 with the diameter of about 110 mm. Here, the average diameter or width ($d_5$) of the diamond particles is from about 100, to 120 μm (for example, 110 μm), and the average distance ($d_4$) between the diamond particles 130 is greater than about 500 μm (for example, 600 μm). For efficient slurry flows it can be designed that the width ($_a$1) of the slurry passages 114 between each conditioning zone 120 is greater than about 1.5 mm (for example, 1.86 mm); the diameter (2×d3) of the center area 112 is more than about 10 mm (for example, 20 mm); and the peripheral area 116 is more than about 5 mm (for example 8 mm).

Figure 7:
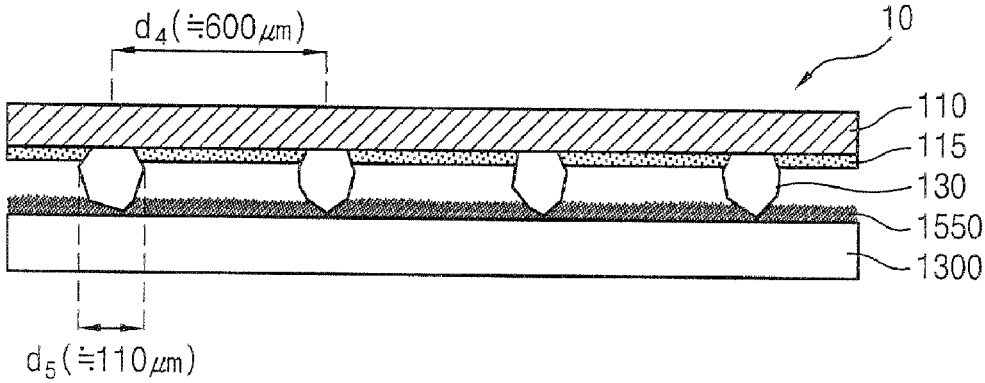
FIG. 7 is a sectional view illustrating a conditioner device for the polishing pad of a CMP apparatus according to an exemplary embodiment of the present invention.

Referring to FIG. 7, the conditioner device 100 includes the circular support plate 110 to which about 30,000 diamond particles 130 are attached by the adhesive layer, the diamond particles 130 with the average diameter or width ($d_5$) of about 110 μm, being arranged in an average distance ($d_4$) of separation of about 600 μm. Since the distance ($d_4$) between the diamond particles 130 is large enough, the slurry 1550 supplied onto the polishing pad 1300 flows efficiently through the diamond particles 130, substantially reducing the abrasion of the diamond particles 130 which is caused by the slurry 1550. With the abrasion of the diamond particles 130 being minimized, the conditioning efficiency to the polishing pad 1300 decreases more slowly and the lifetime of the conditioner device 100 increases.

Figure 8:
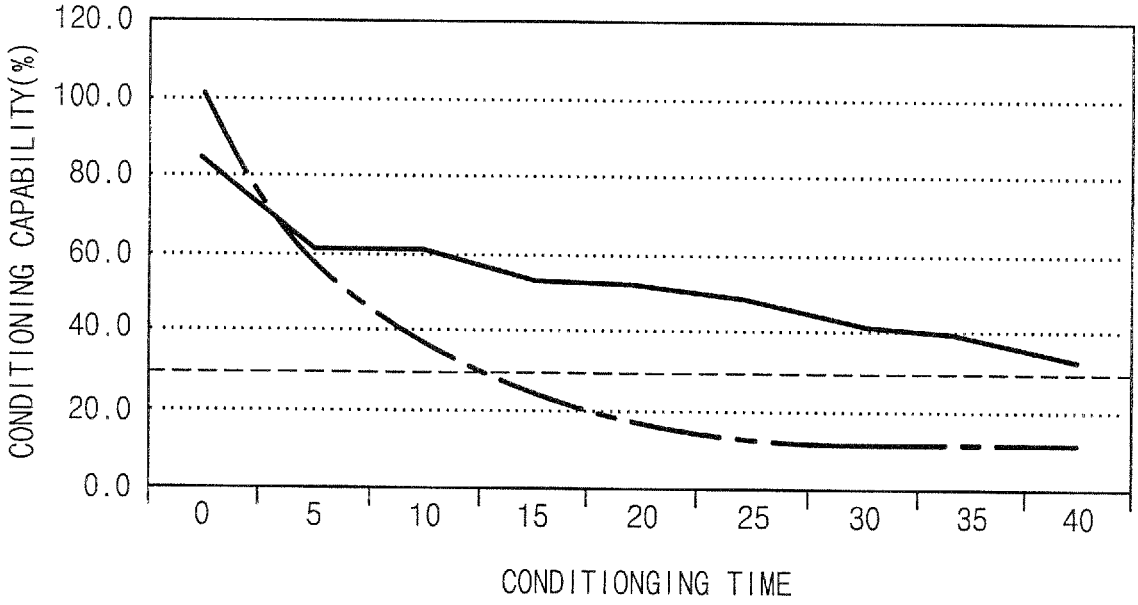
FIG. 8 is a graph illustrating the changes in the conditioning efficiency of the conditioner device for the polishing pad of a CMP apparatus according to an exemplary embodiment of the present invention.

FIG. 8 is a graph illustrating the changes in the conditioning efficiency to of the conditioner device for the polishing pad of a CMP apparatus according to an exemplary embodiment of the present invention. Referring to FIG. 8, the polishing capability or conditioning efficiency of the conventional conditioner device (dashed line) decreases below 30% of the initial value after 15 hours of conditioning time. Here, 30% of the initial conditioning efficiency is the minimum or thresh-hold value, therefore the conditioner device of which conditioning efficiency being lower than the minimum or thresh-hold value can not be applied for the process. The type of the slurry used here is the tungsten slurry which abrades the diamond particles more quickly. The horizontal axis of the graph represents the conditioning time in hour, and the vertical axis, the decrease of the conditioning efficiency (or polishing capability) in percentage (%). It is shown that the conditioning efficiency of the conditioner device of the present invention (solid line) is more than 50% after 15 hours of the conditioning time and can be used up to 40 hours under the same condition.

Figure 9:
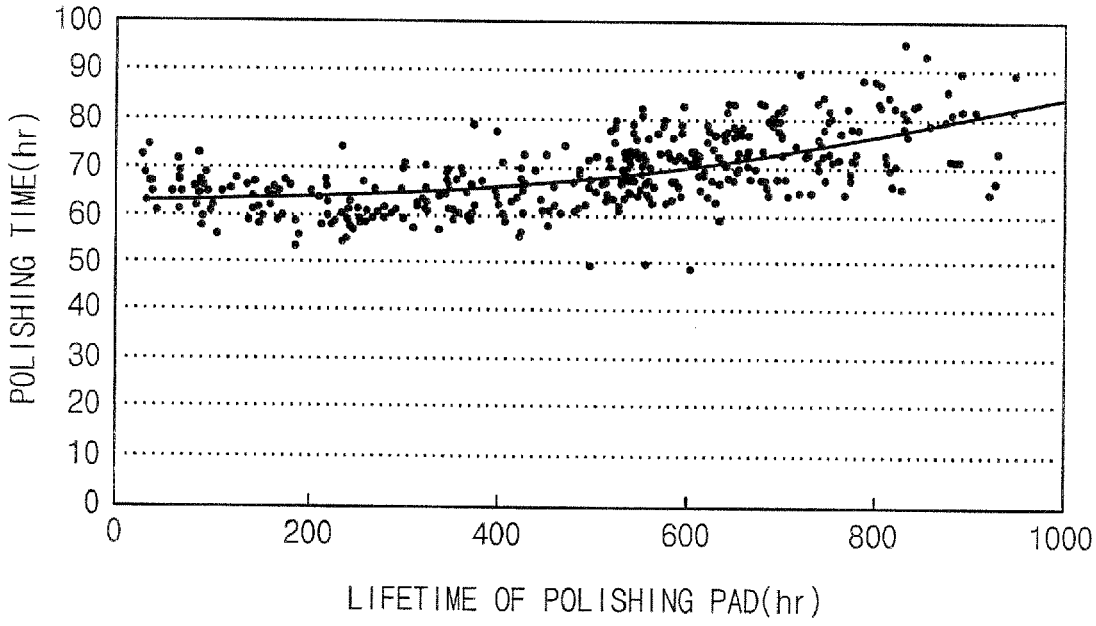
Fig. 9 (CONVENTIONAL ART)
FIG. 9 is a graph illustrating the polishing time vs. the lifetime of the polishing pad of a conventional CMP apparatus.
Figure 10:
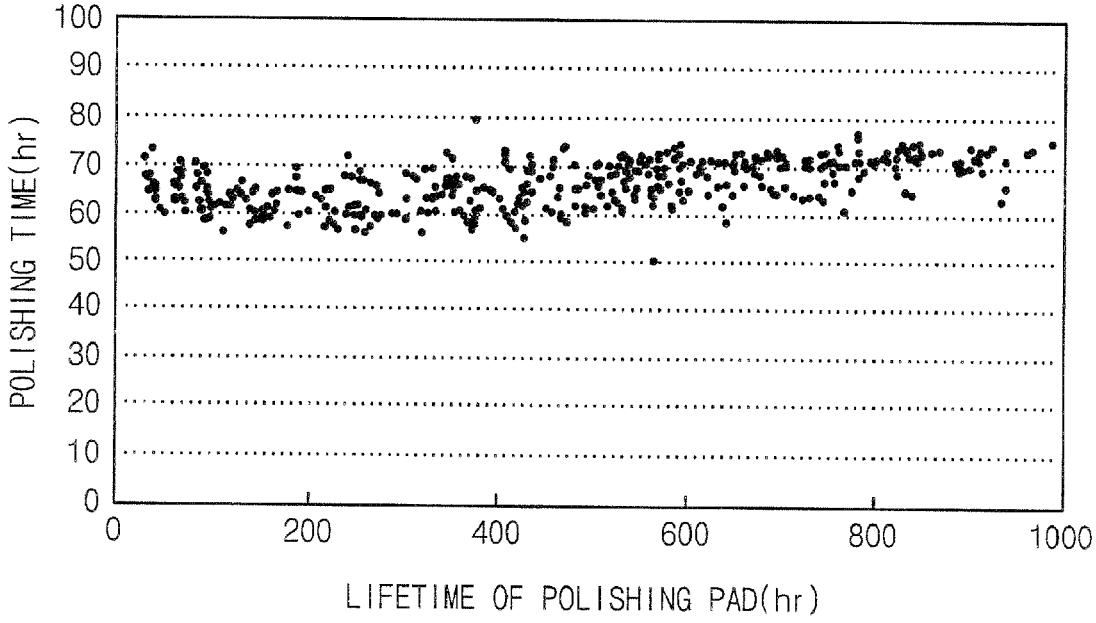
FIG. 10 is a graph illustrating the polishing time vs. the lifetime of the polishing pad of a CMP apparatus according to an exemplary embodiment of the present invention.

FIG. 9 is a graph illustrating the changes in the required polishing time of the polishing pad of a conventional CMP apparatus, and FIG. 10 is a graph illustrating the changes in the required polishing time of a CMP apparatus of the present invention. With the conventional conditioner device, referring FIG. 9, the required polishing time increases continually and the range of the required polishing time becomes unstable with use of the polishing pad, after a certain amount of time elapsed in a tungsten CMP process. However, referring to FIG. 10, the required polishing time does not increase abruptly and the range of the required polishing time stays stable with the conditioner device of the CMP apparatus of the present invention.

Figure 11:
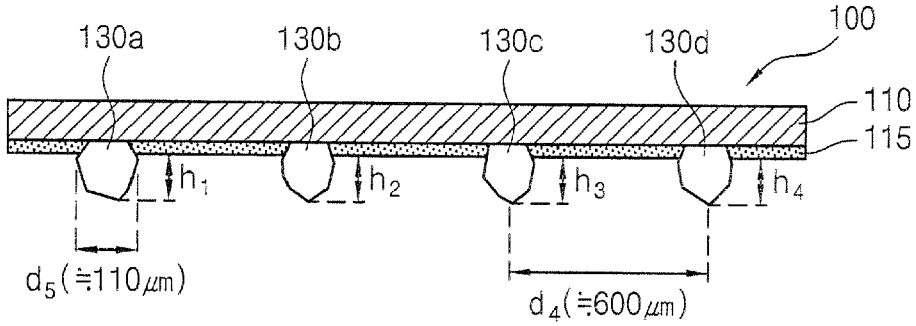
FIG. 11 is a sectional view illustrating a conditioner device for the polishing pad of a CMP apparatus according to an exemplary embodiment of the present invention.

FIG. 11 is a sectional view illustrating a conditioner device for the polishing pad of a CMP apparatus according to an exemplary embodiment of the present invention. Referring to FIG. 11, the extrusion heights ($h_1$, $h_2$, $h_3$, $h_4$) of the diamond particles 130*a*, 130*b*, 130*c*, 130*d* on the conditioner device 100 can be designed to be the same or different from one another. By adjusting the difference (Δh) of the extrusion height ($h_1$-$h_4$), the conditioning efficiency to the polishing pad can be set or maintained as desired. The difference (Δh) of the extrusion height ($h_1$-$h_4$) can be designed to be 10% to 20% of the average diameter or width ($d_5$) of the diamond particles 130*a*, 130*b*, 130*c*, 130*d*.

For example, supposing that there are about 30,000 diamond particles (130*a*-130*d*) of which the average diameter or width ($d_5$) is about 110 μm and the average distance is about 600 μm, the difference (Δh) of the extrusion height ($h_1$-$h_4$) can be designed to be about 10 ml, or to be about 20 μm.

Figure 12:
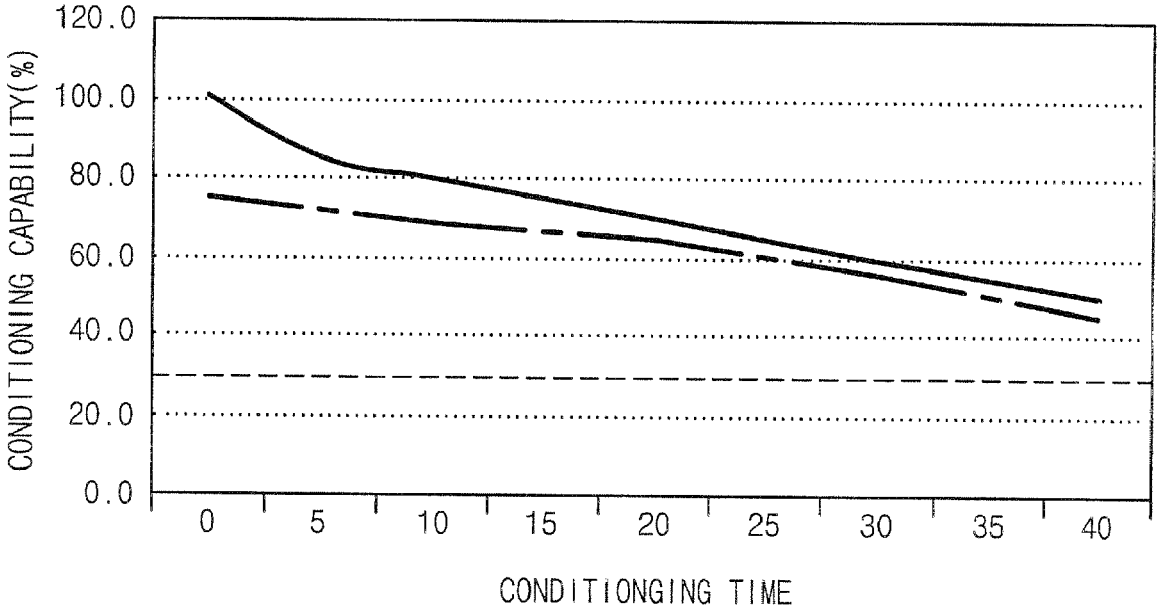
FIG. 12 is a graph illustrating the changes in the conditioning efficiency based on the differences of the extrusion heights of the diamond particles on the conditioner device for the polishing pad of the CMP apparatus of the present invention.

FIG. 12 is a graph illustrating the changes in the conditioning efficiency according to the difference of the extrusion heights of the diamond particles on the conditioner device for the polishing pad of the CMP apparatus of the present invention. In FIG. 12, the solid line denotes the conditioning efficiency of the conditioner device of the higher extrusion height difference (Δh), the extrusion height difference (Δh) being about 20 μm, while the dashed line, the conditioning efficiency of the conditioner device of the lower extrusion height difference (Δh), the extrusion height difference being about 10 μm. Thus, the conditioning efficiency can be set or maintained to be relatively higher for the conditioner device of the higher extrusion height difference (Δh) compared with the conditioner device of the lower extrusion height difference (Δh). When the difference (Δh) of the extrusion height ($h_1$-$h_4$) of the diamond particles (130*a*~130*d*) is set to be larger, as shown in FIG. 11, the tips of the diamond particles (130*a*~130*d*) touch not only the surface of the polishing pad but also the deep inside of the grooves in the polishing pad, whereupon removing effectively the polishing particles of the slurry, byproducts of the CMP process, other deposited materials and the debris from the polishing pad.

Figure 13:
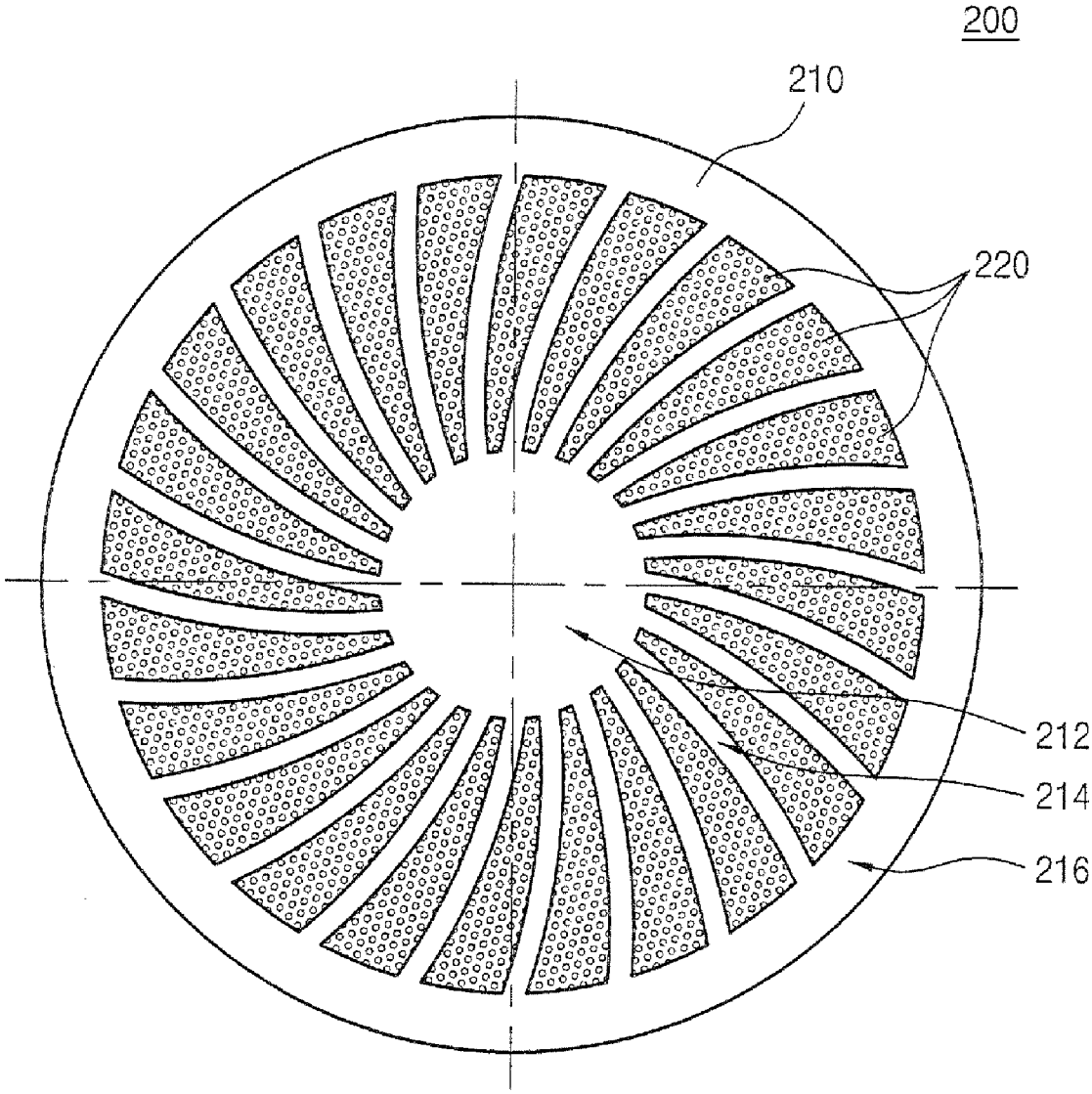
FIG. 13 to FIG. 15 are plan views illustrating respectively conditioner devices for the polishing pad of a CMP apparatus according to the different exemplary embodiments of the present invention.
Figure 14:
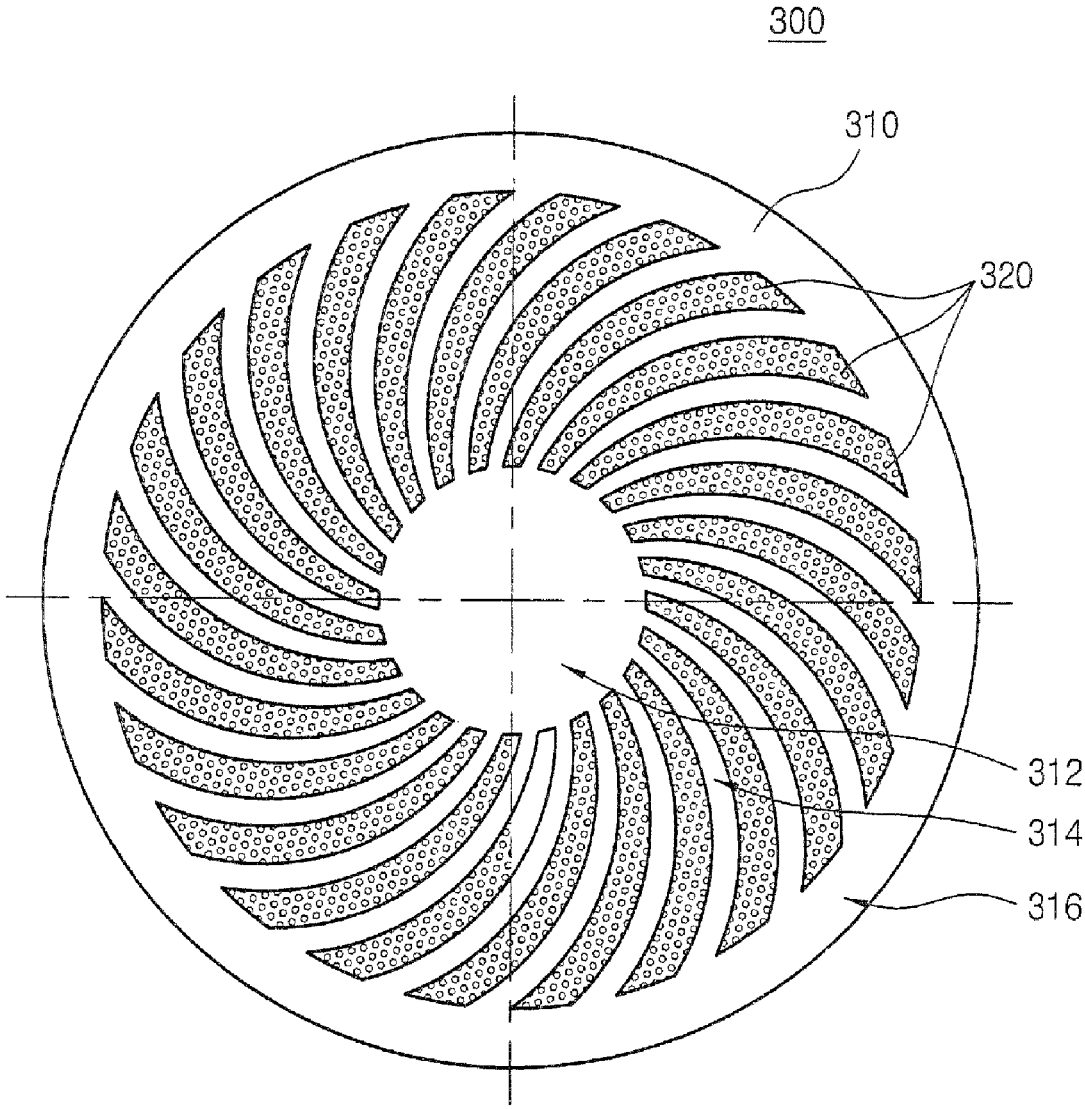
Figure 15:
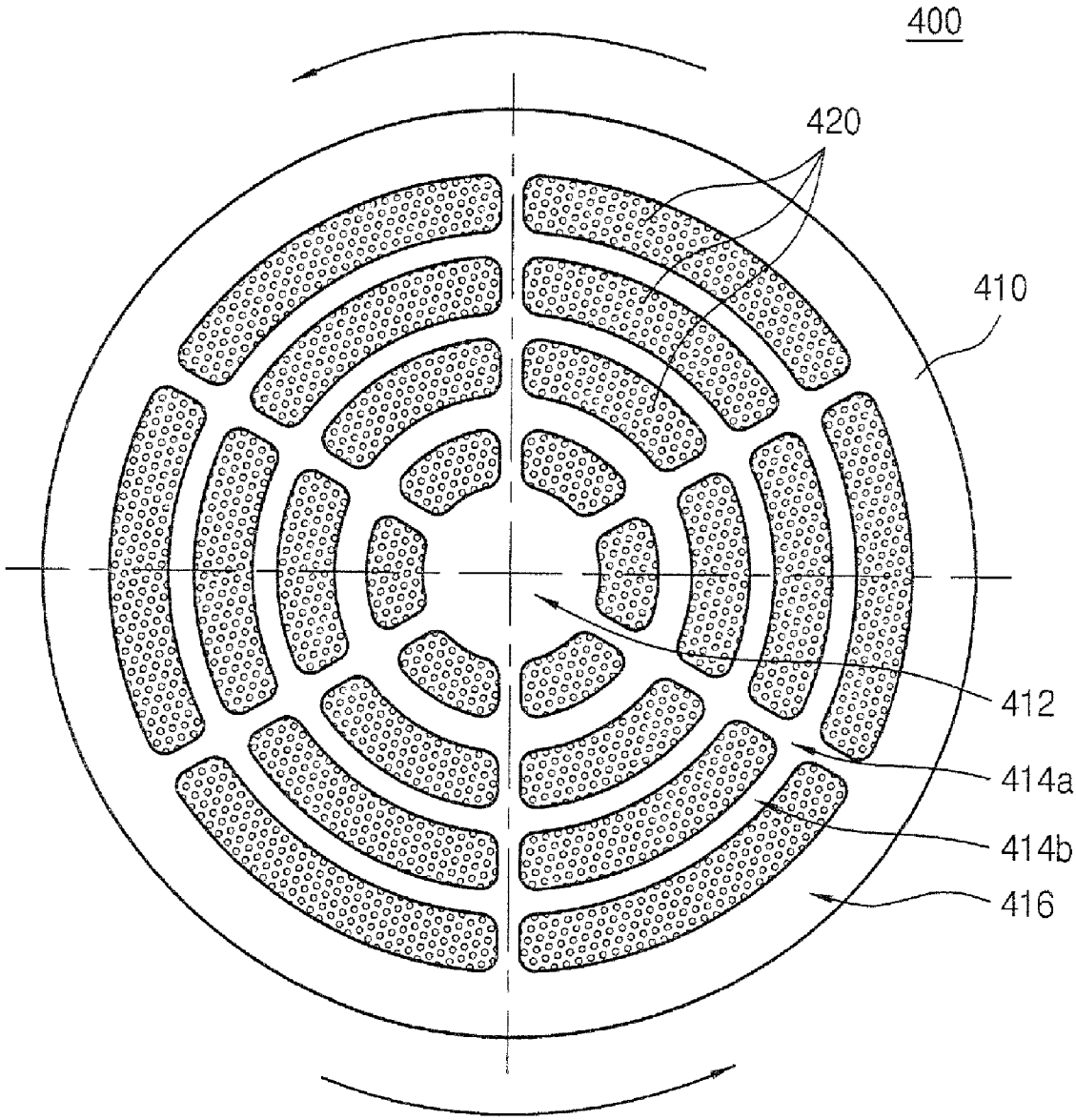

FIG. 13 to FIG. 15 are plane views respectively illustrating conditioner devices for the polishing pad of a CMP apparatus according to different exemplary embodiments of the present invention. The conditioner devices of FIG. 13 to FIG. 15 are largely similar to the conditioner device 100 of FIG. 5, so different features will be explained below, while descriptions are just roughly given or omitted for the same features.

According to a different embodiment of the present invention, referring to FIG. 13, the conditioner device 200 includes a plurality of conditioning zones 220 of which boundaries extend along curved lines from the rotation axis of the support plate 210 to the peripheral edge of the support plate 210, with the azimuthal dimension of the conditioning zones 220 gradually increasing with the radial distance from the rotation axis of the support plate 210. All of the conditioning zones 220 are curved from the center toward the perimeter. A plurality of diamond particles are attached to the plurality of the conditioning zones 220, the diamond particles separated in relatively large distances (for example, 600 μm) from one another. The empty areas 212, 214, 216 between the plurality of the conditioning zones 220 are the slurry passages for the slurry flows.

Referring to FIG. 14, according to another different embodiment of the present invention, the conditioner device 300 includes a plurality of conditioning zones 320 of which boundaries extend along curved lines from the rotation axis of the support plate 310 to the peripheral edge of the support plate 310 as of FIG. 13. However, the azimuthal dimension of the conditioning zones is substantially constant at any radial distance from the rotation axis of the support plate 310 in this embodiment. The empty areas 312, 314, 316 between the plurality of the conditioning zones 320 are the slurry passages for the slurry flows.

Referring to FIG. 15, according to yet another different embodiment of the present invention, the conditioner device 400 includes a plurality of conditioning zones 420 on a circular support plate 410, the conditioning zones 420 extending in a rotational or azimuthal direction (denoted by a solid arrow), while the radial dimension of the conditioning zones 420 being substantially constant. The whole conditioning zones 420 may be arranged in radial direction, forming a web-like configuration. The empty areas 412, 414*a*, 414*b*, 416 between the plurality of the conditioning zones 420 are the slurry passages for the slurry flows. Since the slurry passages are formed also in the rotation direction (denoted by a solid arrow) of the support plate 410, the slurry flows more efficiently.

Although the present invention has been described in connection with the embodiment of the present invention illustrated in the accompanying drawings, it is not limited thereto. It will be apparent to those skilled in the art that various substitution, modifications and changes may be thereto without departing from the scope and spirit of the invention.

What is claimed is:

1. A conditioner device comprising:

a rotatable support plate including a support plate surface comprising a center area located about the rotational axis of the support plate, a mid area surrounding the center area, and a peripheral area surrounding the mid area;

a plurality of conditioning zones located within a portion of the mid area of the support plate surface, the plurality of conditioning zones occupying from about 60% to 70% of the total area of the support plate surface;

a plurality of hard particles which are densely arranged within the conditioning zones and are attached to the support plate surface; and a plurality of passages defined by said conditioning zones within which a slurry flows, the passages occupying a portion of the mid area which is not occupied by the conditioning zones, the center area and the peripheral area.

2. The conditioner device of claim 1, wherein the plurality of passages occupy about 30% to 40% of the total area of the support plate surface, and partitions the plurality of conditioning zones.

3. The conditioner device of claim 1, wherein an average distance between the plurality of the hard particles is about 5 to 7 times the average size of the hard particles.

4. The conditioner device of claim 3, wherein the plurality of hard particles are arranged such that each hard particle is located at each corner of a square grid.

5. The conditioner device of claim 3, wherein a plurality of hard particles have extruding heights which are different from each other, the extruding heights being measured from the support plate surface.

6. The conditioner device of claim 5, wherein the difference of extruding heights of the plurality of hard particles is in from about 10% to 20% of the average size of the plurality of the hard particles.

7. The conditioner device of claim 1, wherein the plurality of the hard particles comprise diamond particles.

8. A conditioner device comprising:

a rotatable circular support plate including a support plate surface comprising a circular-shaped center area located about the rotational axis of the support plate surface, a ring-shaped mid area surrounding the center area, and a ring-shaped peripheral area surrounding the mid area;

a plurality of radially-extending conditioning zones located within the mid area of the support plate surface, the plurality of the conditioning zones occupying about 60% to 70% of the total area of the support plate surface;

a plurality of hard particles which are densely arranged within the conditioning zones and are attached to the support place surface; and a plurality of slurry passages comprising a first slurry passage that is circular and is defined by the center area, a second slurry passage that is a ring shape and is defined by the peripheral area, and a third slurry passage that is defined by the regions between the plurality of the conditioning zones and connects the respective first slurry passage and the second slurry passage.

9. The conditioner device of claim 8, wherein the plurality of the conditioning zones are shaped as follows:

the conditioning zone of which boundaries extend along straight lines from the rotation axis of the support plate to the peripheral edge of the support plate, with the azimuthal dimension of the conditioning zone gradually increasing with the radial distances from the rotation axis of the support plate.

10. The conditioner device of claim 8, wherein the plurality of the conditioning zones are shaped as follows:

the conditioning zone of which boundaries extend along curved lines from the rotation axis of the support plate to the peripheral edge of the support plate, with the azimuthal dimension of the conditioning zone gradually increasing with the radial distances from the rotation axis of the support plate.

11. The conditioner device of claim 8, wherein the plurality of the conditioning zones are shaped as follows:

the conditioning zone of which boundaries extend along curved lines from the rotation axis of the support plate to the peripheral edge of the support plate, with the azimuthal dimension of the conditioning zone being substantially constant at any radial distance from the rotation axis of the support plate.

12. The conditioner device of claim 8, wherein the plurality of the conditioning zones are shaped as follows:

the conditioning zone which extends in the azimuthal direction of the support plate, with the radial dimension of the conditioning zone being substantially constant at any azimuthal location.

13. The conditioner device of claim 8, wherein the slurry passages occupy about 30% to 40% of the total area of the support plate surface.

14. The conditioner device of claim 8, wherein an average distance between the plurality of the hard particles is about 5 to 7 times of the average size of the hard particles.

15. The conditioner device of claim 8, wherein a plurality of the hard particles have extruding height which are different from another, each of the extruding heights being measured from the support plate, the difference of the extruding heights being in the range of about 10% to 20% of the average size of the plurality of the hard particles.

16. A chemical mechanical polishing apparatus comprising:

a rotatable platen;

a polishing pad positioned on the platen;

a rotatable wafer carrier for mounting and polishing a wafer, the wafer carrier facing the polishing pad;

a slurry supply nozzle for supplying a slurry to the polishing pad;

a rotatable conditioner device comprising a support plate surface, the support plate surface comprising a plurality of conditioning zones having a plurality of hard particles which are densely arranged within the conditioning zones and attached to the support plate surface, the hard particles for maintaining the surface roughness of the polishing pad, and slurry passages for providing spaces for slurry flows between the plurality of the conditioning zones, the plurality of the conditioning zones occupy about 60% to 70% of the total area of the support plate, and the slurry passages occupy about 30% to 40% of the total of the support plate; and a rotation axis comprising an arm to which the conditioner device is installed.

17. The apparatus of claim 16, wherein the plurality of conditioning zones are arranged in a radial direction and occupy portion of a mid area of the support plate, the mid area being located between a center area and a peripheral area of the support plate.

18. The apparatus of claim 17, wherein the slurry passages comprising:

a first slurry passage that is a circular shape and is located in the center area;

a second slurry passage that is a ring shape and is located in the peripheral area; and a third slurry passage that is located in the regions between the plurality of the conditioning zones and connects the first slurry passage and the second slurry passage.

19. The apparatus of claim 16, wherein the plurality of hard particles are densely arranged on the support plate surface such that the average distance between the hard particles is about 5 to 7 times of the average size of the hard particles.

20. A conditioner device comprising:

a rotatable support plate including a support plate surface comprising a center area located about the rotational axis of the support plate, a mid area surrounding the center area, and a peripheral area surrounding the mid area;

a plurality of conditioning zones located within a portion of the mid area of the support plate surface;

a plurality of hard particles which are densely arranged within the conditioning zones and are attached to the support plate surface; and a plurality of passage defined by said conditioning zones within which a slurry flows, the passages occupying a portion of the mid area which is not occupied by the conditioning zones, the center area and the peripheral area, the plurality of passages occupying about 30% to 40% of the total area of the support plate surface and partitioning the plurality of conditioning zones.

21. A conditioner device comprising:

a rotatable circular support plate including a support plate surface comprising a circular-shaped center area located about the rotational axis of the support plate surface, a ring-shaped mid area surrounding the center area, and a ring-shaped peripheral area surrounding the mid area;

a plurality of radically-extending conditioning zones located within the mid area of the support plate surface;

a plurality of hard particles which are densely arranged within the conditioning zones and are attached to the support place surface; and a plurality of slurry passages comprising a first slurry passage that is circular and is defined by the center area, a second slurry passage that is a ring shape and is defined by the peripheral area, and a third slurry passage that is defined by the regions between the plurality of the conditioning zones and connects the respective first slurry passage and the second slurry passage, wherein the plurality of the conditioning zones are shaped such that the conditioning zone of which boundaries extend along straight lines from the rotation axis of the support plate to the peripheral edge of the support plate, the azimuthal dimension of the conditioning zone gradually increasing with the radical distances from the rotation axis of the support plate.

22. A conditioner device comprising:

a rotatable circular support plate including a support plate surface comprising a circular-shaped center area located about the rotational axis of the support plate surface, ring-shaped mid area surrounding the center area, and a ring-shaped peripheral area surrounding the mid area;

a plurality of radically-extending conditioning zones located within the mid area of the support plate surface;

a plurality of hard particles which are densely arranged within the conditioning zones and are attached to the support place surface; and a plurality of slurry passages comprising a first slurry passage that is circular and is defined by the center area, a second slurry passage that is a ring shape and is defined by the peripheral area, and a third slurry passage that is defined by the regions between the plurality of the conditioning zones and connects the respective first slurry passage and the second slurry passage, wherein the plurality of the conditioning zones are shaped such that the conditioning zone of which boundaries extend along curved lines from the rotation axis of the support plate to the peripheral edge of the support plate, the azimuthal dimension of the conditioning zone gradually increasing with the radical distances from the rotation axis of the support plate.

23. A conditioner device comprising:

a rotatable circular support plate including a support plate surface comprising a circular-shaped center area located about the rotational axis of the support plate surface, a ring-shaped mid area surrounding the center area, and a ring-shaped peripheral area surrounding the mid area;

a plurality of radically-extending conditioning zones located within the mid area of the support plate surface;

a plurality of hard particles which are densely arranged within the conditioning zones and are attached to the support place surface; and a plurality of slurry passage comprising a first slurry passage that is circular and is defined by the center area, a second slurry passage that is a ring shape and is defined by the peripheral area, and a third slurry passage that is defined by the regions between the plurality of the conditioning zones and connects the respective first slurry passage and the second slurry passage, wherein the plurality of the conditioning zones are shaped such that the conditioning zone which extends in the azimuthal direction of the support plate, the radial dimension of the conditioning zone being substantially constant at any azimuthal location.

24. A conditioner device comprising:

a rotatable circular support plate including a support plate surface comprising a circular-shaped center area located about the rotational axis of the support plate surface, a ring-shaped mid area surrounding the center area, and a ring-shaped peripheral area surrounding the mid area;

a plurality of radically-extending conditioning zones located within the mid area of the support plate surface;

a plurality of hard particles which are densely arranged within the conditioning zones and are attached to the support place surface; and a plurality of slurry passages comprising a first slurry passage that is circular and is defined by the center area, a second slurry passage that is a ring shape and is defined by the peripheral area, and a third slurry passage that is defined by the regions between the plurality of the conditioning zones and connects the respective first slurry passage and the second slurry passage, the slurry passages occupying about 30% to 40% of the total area of the support plate surface.

* * * * *

UNITED STATES PATENT AND TRADEMARK OFFICE

CERTIFICATE OF CORRECTION

PATENT NO. : 7,578,727 B2
APPLICATION NO. : 11/466425
DATED : August 25, 2009
INVENTOR(S) : Moon et al.

It is certified that error appears in the above-identified patent and that said Letters Patent is hereby corrected as shown below:

On title page Item (75) the inventor "Sung-Tae Moon" should read -- Sung-Taek Moon --;

Column 5, lines 11-12, the word "constricted" should read -- constructed --;

Column 7, line 22, the word "100," should read -- 100 μm --;

Column 7, line 25, the word "($_d$1)" should read -- ($d_1$) --;

Column 8, line 27, the word "ml" should read -- μm --;

Column 11, line 25, the word "total" should read -- total area --;

Column 11, line 57, the word "passage" should read -- passages --;

Column 12, line 3, the word "radically-extending" should read -- radially-extending --;

Column 12, line 19, the word "radical" should read -- radial --;

Column 12, line 25, the word "ring-shaped" should read -- a ring-shaped --;

Column 12, line 27, the word "radically-extending" should read -- radially-extending --;

Column 12, line 43, the word "radical" should read -- radial --;

Column 12, line 51, the word "radically-extending" should read -- radially-extending --;

Column 12, line 56, the word "passage" should read -- passages --;

UNITED STATES PATENT AND TRADEMARK OFFICE

CERTIFICATE OF CORRECTION

PATENT NO. : 7,578,727 B2
APPLICATION NO. : 11/466425
DATED : August 25, 2009
INVENTOR(S) : Moon et al.

It is certified that error appears in the above-identified patent and that said Letters Patent is hereby corrected as shown below:

Column 13, line 7, the word "radically-extending" should read -- radially-extending --.

Signed and Sealed this

Twenty-second Day of December, 2009

David J. Kappos

David J. Kappos
*Director of the United States Patent and Trademark Office*